US006537486B1

(12) United States Patent
Benson et al.

(10) Patent No.: US 6,537,486 B1
(45) Date of Patent: Mar. 25, 2003

(54) ANTI-BUILDUP LINER

(75) Inventors: Paul Martin Benson, Allegheny County, PA (US); John Prentiss Sanders, III, Allegheny County, PA (US)

(73) Assignee: Yesuvius Crucible Company, Wilmington, DE (US)

( * ) Notice: Subject to any disclaimer, the term of this patent is extended or adjusted under 35 U.S.C. 154(b) by 0 days.

(21) Appl. No.: 09/528,295

(22) Filed: Mar. 17, 2000

(51) Int. Cl.[7] ..... B22D 41/08
(52) U.S. Cl. ..... 266/280; 222/606
(58) Field of Search ..... 266/280, 281; 222/606, 594

(56) References Cited

U.S. PATENT DOCUMENTS

| | | | | | |
|---|---|---|---|---|---|
| 2,943,240 | A | * | 6/1960 | Martinet | 266/280 |
| 3,901,721 | A | * | 8/1975 | Doman | 106/58 |
| 4,292,082 | A | * | 9/1981 | Danjyo et al. | 501/100 |
| 4,407,972 | A | | 10/1983 | Brenzy | |
| 4,870,037 | A | | 9/1989 | Hoggard et al. | |
| 4,871,698 | A | | 10/1989 | Fishler et al. | |
| 5,046,647 | A | | 9/1991 | Kawai et al. | |
| 5,060,831 | A | | 10/1991 | Fishler et al. | |
| 5,083,687 | A | | 1/1992 | Saito et al. | |
| 5,086,957 | A | | 2/1992 | Ozeki et al. | |
| 5,151,201 | A | * | 9/1992 | Fishler et al. | 222/606 |
| 5,185,300 | A | | 2/1993 | Hoggard et al. | |
| 5,244,130 | A | | 9/1993 | Ozeki et al. | |
| 5,286,685 | A | | 2/1994 | Schoennahl et al. | |
| 5,370,370 | A | | 12/1994 | Benson | |
| 5,628,939 | A | * | 5/1997 | Reiterer et al. | 264/29.1 |
| 5,691,061 | A | | 11/1997 | Hanse et al. | |
| 5,885,520 | A | | 3/1999 | Hoover | |

FOREIGN PATENT DOCUMENTS

| | | | | |
|---|---|---|---|---|
| DE | 2824773 | A | | 12/1978 |
| EP | 0423793 | A | | 4/1991 |
| EP | 0472350 | B | | 2/1992 |
| GB | 2135918 | A | | 9/1984 |
| JP | 04094851 | A | | 3/1992 |
| JP | 2-12664 | | | 5/1992 |
| JP | 05057410 | A | * | 3/1993 |
| WO | WO 96/34838 | | | 11/1996 |

OTHER PUBLICATIONS

D.P.H. Hasselman; "Unified Theroy of Thermal Shock Fracture Initiation . . . "; Journal of the American Ceramic Society, Nov. 1969, vol. 52, No. 11, pp. 600–604.

Wolfram Holler; "Prevention of Alumina Clogging in Submerged Nozzles for Continuous Casting of Steel by Introduction of a Carbon Free Layer"; Veitsch Radex Rundschau; Jan. 1999 S30–39.

* cited by examiner

*Primary Examiner*—Scott Kastler
(74) *Attorney, Agent, or Firm*—James R. Williams

(57) ABSTRACT

A refractory shape is described for transferring molten metal in a continuous casting operation. The shape includes an inner surface made from an unfired composition comprising a calcium rich grain, a hydration-resistant grain, 6–28 wt. % carbon, and a binder. The unfired composition may also include an antioxidant and silica. The inner surface resists spalling and alumina deposition.

19 Claims, No Drawings

ANTI-BUILDUP LINER

FIELD OF THE INVENTION

This invention relates generally to refractory articles and, more particularly, to a refractory shape for transferring molten metal in a continuous casting operation.

DESCRIPTION OF THE PRIOR ART

Refractory shapes are commonly used to control the flow of molten steel in continuous casting operations. Such shapes will often have an inner surface defining a bore through which the molten steel may flow. These shapes may be, for example, nozzles and shrouds, and often are made from a first composition comprising at least one refractory oxide and graphite combined in a carbon-bonded matrix. Graphite improves thermal shock resistance of the shape, but oxidation of the graphite can lead to excessive erosion. A typical fist composition comprises alumina and a lessor amount of graphite.

Refractory shapes also function to protect the steel from contact with air and the resultant oxidation. To reduce oxygen content in the steel itself, molten steel is often "killed," that is purged of oxygen, commonly by the addition of aluminum metal. Aluminum metal reacts with dissolved oxygen or iron oxide to form finely dispersed alumina, some of which floats into the slag above the molten metal and some of which remains as dispersed particles in the molten steel.

The presence of alumina in the molten steel can result in the deposition of alumina along the inner surface of the refractory shape. Alumina-graphite refractories, although commonly used in refractory shapes, are very susceptible to alumina deposition. Deposition leads to constriction, and possibly clogging, of the bore. The bore may be unclogged using an oxygen lance; however, lancing disrupts the casting process, reduces refractory life, and decreases casting efficiency and the quality of the steel produced. A total blockage of the bore by alumina decreases the expected life of the refractory shape and is very costly and time-consuming to steel producers. For example, steel having an initially high dissolved oxygen content can limit a shroud to 2–3 ladles due to heavy alumina buildup in the bore.

Various techniques have been tried to reduce alumina clogging. A common industrial technique is the injection of an inert gas, such as argon, into the refractory shape. The inert gas is thought to form a protective barrier between the molten steel and the carbon-bonded refractory. Gas injection requires large volumes of inert gas, complicated refractory designs, and is not always an effective solution. Inert gas at high pressure may also dissolve into the molten metal causing defects, such as pinholes, in the cast steel.

Instead of, or in combination with, inert gas injection, the inner surface of the refractory shape may comprise a second refractory composition or liner that either sloughs off as alumina deposits on the surface or does not interact with the molten steel to form alumina deposits. Compositions that slough off may contain or form low melting point materials. U.S. Pat. No. 5,046,647 to Kawai et al. describes a liner comprising calcia/silica capable of forming a low melting point compound. Calcia, however, is prone to hydration, which may create a potentially explosive condition during use. U.S. Pat. No. 5,060,831 to Fishler et al. teaches a composition consisting of carbon and a homogeneous fused mixture of calcia and zirconia that can form a low melting point eutectic with alumina. Zirconia is described as stabilizing the calcia against hydration. U.S. Pat. No. 5,244,130 claims a liner comprising calcium zirconate, graphite, and stabilized calcium silicate that can form low melting point materials. Although complexing calcia with zirconia and silica may reduce destructive hydration, the calcia may not be available to prevent alumina clogging.

Several patents have attempted to produce a liner that is resistant to alumina deposition. U.S. Pat. Nos. 4,870,037 to Hoggard et al. and U.S. Pat. No. 4,871,698 to Fishler et al. teach a liner that reduces alumina clogging, where the liner consists essentially of SiAlON and graphite. Unfortunately, SiAlON liners are not economical. U.S. Pat. Nos. 5,370,370 to Benson and U.S. Pat. No. 5,691,061 to Hanse et al. teach an anti-clogging liner that is made essentially carbon-free by the controlled oxidation of a carbon-containing material. The absence of carbon is believed to inhibit alumina deposition, but the process necessary to oxidize the carbon and effect the required compositional changes is not always practical.

Anti-clogging liners have also been made with aluminum nitride (AlN) bonded refractories as exemplified by U.S. Pat. No. 5,286,685 to Schoennahl. AlN is produced in situ by firing under a nitrogen atmosphere a shape containing powdered aluminum metal. This process is both dangerous, due to the presence of a reactive metal powder, expensive, and time consuming.

GB 2,135,918 to Rosenstock et al. teaches a magnesia liner. Magnesia does not promote alumina deposition, but does suffer from poor thermal shock resistance, spalling and erosion. To improve thermal shock resistance, JP 2-12664 to Tabata et al. teaches a liner comprising 50–90 wt. % magnesia and 10–50 wt. % carbon. The liner may also comprise up to 20 wt. % of additional components, including, for example, chromia, calcia, alumina, silica and zirconia. Additional components can negatively affect hydration, alumina deposition and thermal shock resistance.

U.S. Pat. No. 5,885,520 to Hoover attempts to combine the benefits of calcia and magnesia. It teaches a carbon-bonded liner comprising doloma and more than 33 wt. % graphite. Doloma comprises approximately 58 wt. % calcia and 42 wt. % magnesia. Adequate thermal shock resistance is achieved only when the graphite content is more than about 33 wt. %, but high amounts of graphite can make the composition susceptible to oxidation and erosion, both of which can cause break-out of molten steel.

A need persists for an inexpensive, easily fabricated refractory composition that reduces alumina deposition while resisting oxidation and erosion. Such a composition would be especially useful on the inner surface of a refractory shape, such as, for example, a liner in the bore of a refractory nozzle or shroud.

SUMMARY OF THE INVENTION

The present invention describes a refractory shape for transferring molten metal in a continuous casting operation. One object of the invention is to decrease the build-up of alumina in the bore of such a refractory shape. A second object is to improve the erosion-resistance of the bore to molten steel. A third object of the invention is to reduce destructive hydration of calcia-rich grains. A fourth object of the invention is to enhance the thermal shock resistance of a liner within the bore while using a reduced amount of carbon.

One aspect of the invention teaches a carbon-bonded refractory shape formed from an unfired composition comprising a calcia-rich grain, a hydration-resistant grain, 6–28 wt. % carbon and a sufficient amount of binder. The calcia-rich grain will typically be dolomite, but may also be, for example, calcia, calcium zirconate, calcium silicate, calcium titanate and their combinations. Preferably, the calcia-rich grain will contain at least about 45 wt. % calcia. The hydration-resistant grain is less prone to hydrate than calcia and does not promote alumina deposition. Examples include magnesia, zirconia, various nitrides and silicates, and combinations thereof.

Another aspect of the invention describes the calcia-rich grain as coarse and the hydration-resistant grain as sufficiently fine so as to fit within the interstices between coarse calcia-rich grains. The hydration-resistant grain may have a multi-modal size distribution to fit within increasingly small interstices.

One embodiment of the refractory shape is a shroud or nozzle. Alternatively, the shape may be any refractory piece having a bore through which the stream of molten steel flows. Typically, the shape will include a first composition comprising the bulk of the shape and a second composition at least partially lining an inner surface that contacts the stream of molten steel. The second composition is formed from the unfired composition.

In another aspect of the invention, the unfired composition also comprises an anti-oxidant. The anti-oxidant may be an oxygen scavenger or flux. Examples of the former include nitrides, carbides, borides, and reactive metals. Fluxes may include silicates, borates and fluorides. The unfired composition may also comprise silica.

DESCRIPTION OF THE PREFERRED EMBODIMENTS

The present invention concerns a fired, carbon-bonded refractory shape used in the continuous casting of molten steel and having a bore resistant to alumina clogging. Shapes include refractory pieces used in the continuous casting of steel, including, for example, slide gate plates, nozzles, integral pieces comprising a slide gate plate and nozzle, and parts thereof. Nozzles include nozzle seats, metering nozzles for nozzle changers, internal nozzles, and sub-entry nozzles and shrouds.

The refractory shape may also comprise a first composition and a second composition. The first composition forms the bulk of the shape and may be any standard refractory. Commonly, the first composition is carbon-bonded, and a representative composition is carbon-bonded alumina-graphite. The second composition, or liner, will form at least part of an inner surface that defines a bore through which the molten steel flows. Conveniently, the liner will be less than about 4 cm thick around the bore. The invention is particularly well suited as a liner. Any number of well-known methods may join together the first and second compositions, including, but not limited to, mechanical interlocking, cementing or co-pressing. A third composition may also be included to reduce physical or chemical incompatibilities, such as differences in thermal expansion, between the first and second compositions.

The fired refractory shape is formed from an unfired composition comprising a calcia-rich grain, hydration-resistant grain, carbon and a sufficient amount of binder to form a carbon-bonded refractory upon firing. Firing occurs in a non-oxidizing atmosphere at a temperature of at least 800° C., and produces a carbon-bonded refractory shape. The unfired composition comprises about 35–55 wt. % calcia-rich grain, 15–35 wt. % hydration-resistant grain, 6–28 wt. % carbon and a sufficient amount of binder to form a carbon-bonded refractory.

The calcia-rich grain may be any natural or synthetic mineral or mixture having calcia in an effective amount. Suitable calcia-rich grains include, for example, calcia, dolomite, calcium zirconate, calcium titanate, calcium silicate and combinations thereof. An effective amount means an amount at which alumina deposition is kept within manageable levels. This will occur more easily where calcia is free, such as pure calcia, as opposed to complexed, as in zirconates. For many applications, this implies a calcia concentration of at least about 45 wt. % in the grain. Pure calcia tends to hydrate quickly, so minerals or mixtures containing calcia are preferred, where the mineral or mixture contains a second material resistant to hydration. Dolomite, a mineral containing approximately 58 wt. % calcia and 42 wt. % magnesia, is particularly well suited.

To further reduce hydration, the size of the calcia-rich grain can be increased, thereby reducing surface area and reducing the kinetics of hydration. Advantageously, a large size calcia-rich grain permits small size hydration-resistant-grains to fit within the interstices of the calcia-rich grain. This requires coarse calcia-rich grains to be substantially larger than fine hydration-resistant grains. The combination of coarse and fine particle sizes can increase density, decrease porosity, and reduce erosion of the fired refractory.

The hydration-resistant grain may be any refractory material that is less prone to hydrate than calcia and does not promote alumina deposition. Examples include magnesia, magnesium hydroxide, zirconia, dolomite, magnesia-chrome spinels, boron oxide, various nitrides, silicates and carbonates, and combinations thereof. Alumina and alumina-magnesia spinels should be avoided because they may form low melting phases with calcia. Magnesia is particularly suitable in this capacity because of its cost and commercial availability. Consequently, the hydration-resistant grain will typically comprise a majority of magnesia, and will often be greater than 90 wt. % pure magnesia.

As previously described, the hydration-resistant grain may be present as small particle size grains that fit within the interstices of coarser calcia-rich grains. Finer hydration-resistant grains may also be present that fit within increasingly smaller interstices. One skilled in the art can readily calculate the relative particle size ratios required to ensure packing of hydration-resistant grains within the interstices of coarse calcia-rich grains. Such calculation can even produce mixtures having multi-modal particle sizes. Preferably, hydration-resistant grains will have an average grain size of less than 100 mesh. It is suggested that the high surface area of hydration-resistant grains will adsorb water onto their surfaces thereby further reducing the effects of destructive hydration of the calcia-rich grains.

Carbon may be in any powdered or granular form and is commonly graphite, carbon black or coke; although, any form of elemental carbon may be used. Carbon is present at a level high enough to provide sufficient thermal shock-resistance but low enough to keep erosion and alumina clogging at manageable levels. Unlike prior art compositions, only about 6–28 wt. % carbon is required to provide adequate thermal shock-resistance. Adequate thermal shock-resistance reduces spalling and erosion.

Additionally, low levels of carbon further reduce erosion by decreasing the effects of carbon oxidation. When used as a liner, the composition may contain levels of carbon closer to the lower limit of the range because a thin liner is less likely to suffer from thermal shock-resistance than a thicker refractory article. Liners may include only 6–18 wt. % carbon, and thicker refractory articles typically comprise at least about 15 wt. % carbon. Prior art compositions can contain more than 30 wt. % carbon, and so are more likely to be plagued by oxidation, erosion, and break-out of molten steel.

The binder provides green strength to the unfired shape and carbon-bonding of the fired refractory shape.

Typically, the binder is organic and most typically the binder is a carbon-containing resin, such as a phenolic compound. Numerous other effective binders and resins are known to those skilled in the art. The binder will be present at a level sufficient to form a carbon-bonded refractory shape after firing. Typically, a sufficient amount of binder will be from about 5–15 wt. %.

The unfired composition may also comprise anti-oxidants. An anti-oxidant is any material that reduces the tendency of carbon in the refractory shape to oxidize. Anti-oxidants include oxygen scavengers and barrier coats. Oxygen scavengers preferentially react with oxygen before the carbon. Barrier coats, such as fluxes or glazes, inhibit oxygen diffusion into the composition. Common oxygen scavengers include, for example, boron compounds, carbides, nitrides, and reactive metal powders such as aluminum, magnesium, silicon and mixtures and alloys thereof. The amount of oxygen scavenger depends on the particular use to which the refractory shape will be placed. A minimum of 0.25 wt. % is believed necessary to show demonstrable improvement in oxidation-resistance. Alternatively, more than 7 wt. % is costly, typically unnecessary, and may even be hazardous such as when using reactive metal powders. Additionally, oxygen scavengers may decrease thermal shock-resistance of the fired shape and reduce erosion-resistance to steel.

Barrier coats include fluxes and glazes. A flux is any component that melts either during firing or use, thereby reducing porosity in the refractory shape and creating a physical barrier to oxidation. Fluxes include, but are not limited to, boron oxide, metal borates such as magnesium borate, borosilicates, silicates, and fluorides. Materials, which can act as both fluxes and oxygen scavengers, are especially efficacious and include, for example, boron carbide and boron nitride. A product of the oxidation of boron carbide or boron nitride includes the flux, boron oxide. Glazes are well known to one skilled in the art and are frequently used to inhibit oxidation of the carbon. Glazes may be applied before or after firing, and produce a physical barrier between carbon and oxygen. Glazes frequently comprise silicate frits.

Silica may be included to assist in bonding between the grains, especially at low carbon levels. Grain fusion occurs more rapidly in smaller particle size silicas. Microsilica is preferred, where microsilica means any silica having an average particle size of less than about 500 nm.

The following examples show how the invention may be practiced but should not be construed as limiting the invention. Obviously, numerous modifications and variations of the present invention are possible in light of the above teachings. It is therefore to be understood that within the scope of the appended claims, the invention may be practiced otherwise than as specifically described herein.

EXAMPLE 1

Three rectangular samples, A, B and C, were prepared from three separate compositions. Each was pressed into a rectangular shape and fired in a non-oxidizing atmosphere at over 800° C. Sample A was formed from an unfired composition comprising 49 wt. % coarse dolomite, 25 wt. % fine magnesia, 15 wt. % graphite, 0.75 wt. % boron carbide, 1.5 wt. % aluminum powder, 1 wt. % microsilica, and 9 wt. % binder. Sample B comprised a standard alumina-graphite composition. Sample C was made from a composition described in U.S. Pat. No. 5,885,520 to Hoover, consisting essentially of doloma and greater than 33 wt. % graphite. All were partially submerged in aluminum-killed steel for one hour. Sample B showed extensive alumina build-up on the end that had been submerged in the steel. Sample C exhibited an accumulation of calcium-aluminate. Sample A, however, had no build-up of any kind.

EXAMPLE 2

A mold for a sub-entry nozzle contains a mandrel in the location, which will become the bore of the fired nozzle. A first, unfired composition consisting essentially of:

| | |
|---|---|
| Coarse Dolomite | 46 wt. % |
| Fine Magnesia | 25 wt. % |
| Graphite | 15 wt. % |
| Boron Carbide | 0.75 wt. % |
| Aluminum metal | 1.5 wt. % |
| Microsilica | 1 wt. % |
| Binder | 11 wt. % |

is placed along the entire length of the mandrel to a thickness of less than 2 cm. The remainder of the mold is filled with a standard alumina-graphite mix. The filled mold is isostatically pressed at greater than 5000 psi, and the pressed shape is removed from the mold. The mandrel is removed to expose a bore having an inner surface formed from the first composition. The shape is fired in a non-oxidizing atmosphere at over 800° C. to form nozzle A. Nozzle B is made exactly as nozzle A, but without the first composition. An aggressive aluminum-killed steel is cast through each nozzle. No alumina deposition is noted in nozzle A; however, nozzle B has extensive alumina clogging.

We claim:

1. A refractory shape for transferring molten steel in a continuous casting operation, the shape having an inner surface which forms a bore extending therethrough for the passage of the molten steel, wherein at least part of the inner surface is formed from an unfired composition comprising:

35–55 wt. % calcia-rich grain;,

15–35 wt. % hydration-resistant grain comprising at least about 50 wt. % magnesia;

6–28 wt. % non-cokable carbon; and not more than 15 wt. % binder.

2. The refractory shape of claim 1, wherein the calcia-rich grain comprises at least about 45 wt. % calcia.

3. The refractory shape of claim 1, wherein the calcia-rich grain is selected from the group consisting of calcia, dolomite, calcium zirconate, calcium titanate, calcium silicate, and combinations thereof.

4. The refractory shape of claim 1, wherein the hydration-resistant grain comprises at least one material selected from the group consisting of zirconia, boron oxide, a metal nitride and a silicate.

5. The refractory shape of claim 1, wherein the calcia-rich grain has an average particle size which is substantially larger than an average particle size of the hydration-resistant grain.

6. The refractory shape of claim 5, wherein the average particle size of the hydration-resistant grain is small enough to fit within interstices of the calcia-rich grains.

7. The refractory shape of claim 5, wherein the average particle size of the hydration-resistant grain is less than 100 mesh.

8. The refractory shape of claim 1, wherein the unfired composition comprises 12–18 wt. % non-cokable.

9. The refractory shape of claim 1, wherein the non-cokable carbon comprises graphite.

10. The refractory shape of claim 1, wherein the unfired composition comprises at least 0.25 wt. % anti-oxidant.

11. The refractory shape of claim 10, wherein the anti-oxidant is selected from the group consisting of nitrides, carbides, boron compounds, silicates, fluorides, reactive metals, and combinations thereof.

12. The refractory shape of claim 10, wherein the anti-oxidant is an oxygen scavenger.

13. The refractory shape of claim 10, wherein the anti-oxidant is selected from the group consisting of fluxes and glazes.

14. The refractory shape of claim 10, wherein the anti-oxidant is boron carbide.

15. The refractory shape of claim 1, wherein the unfired composition comprises not more than 5 wt. % silica.

16. The refractory shape of claim 15, wherein silica consists essentially of microsilica.

17. A refractory shape for transferring molten steel in a continuous casting operation, the shape having an inner surface which forms a bore extending therethrough for the passage of the molten steel, wherein at least part of the inner surface is formed from an unfired composition comprising:

35–55 wt. % coarse calcia-rich grain;

15–35 wt. % fine hydration-resistant grain;

6–28 wt. % non-cokable carbon;

not more than 5 wt. % silica; and up to 15 wt. % binder.

18. A refractory shape for transferring molten steel in a continuous casting operation, the shape having an inner surface which forms a bore extending therethrough for the passage of the molten steel, wherein at least part of the inner surface is formed from an unfired composition comprising:

45–50 wt. % coarse particle size dolomite;

20–30 wt. % fine particle size magnesia;

6–28 wt. % graphite;

0.50–1.0 wt. % boron carbide;

1–3 wt. % reactive metal;

0.5–1.5 wt. % microsilica; and

5–10 wt. % binder.

19. A refractory shape for transferring molten steel in a continuous casting operation, the shape having an inner surface which forms a bore extending therethrough for the passage of the molten steel, wherein at least part of the inner surface comprises:

35–55 wt. % coarse calcia-rich grain;

15–35 wt. % hydration-resistant grain; and

6–30 wt. % non-cokable.

* * * * *